US006407721B1

(12) United States Patent
Mehen et al.

(10) Patent No.: US 6,407,721 B1
(45) Date of Patent: Jun. 18, 2002

(54) SUPER THIN, CAVITY FREE SPIRAL ANTENNA

(75) Inventors: Mike Mehen; Gary Salvall; Mark Kusbel, all of Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/819,204

(22) Filed: Mar. 28, 2001

(51) Int. Cl.[7] ..... H01Q 1/36
(52) U.S. Cl. ..... 343/895; 343/700 MS
(58) Field of Search ..... 343/700 MS, 702, 343/729, 821, 846, 895

(56) References Cited

U.S. PATENT DOCUMENTS 4,143,380 A * 3/1979 Kyle ..... 343/895
4,525,720 A * 6/1985 Corzine et al. ..... 343/895
5,508,710 A * 4/1996 Wang et al. ..... 343/726
5,589,842 A * 12/1996 Wang et al. ..... 343/787
5,621,422 A * 4/1997 Wang ..... 343/895
5,936,594 A * 8/1999 Yu et al. ..... 343/895
5,936,595 A * 8/1999 Wang ..... 343/895
5,990,849 A * 11/1999 Salvail et al. ..... 343/895
6,166,694 A * 12/2000 Ying ..... 343/702
6,201,513 B1 * 3/2001 Ow et al. ..... 343/895

* cited by examiner

*Primary Examiner*—Tho Phan
*Assistant Examiner*—Shih-Chao Chen
(74) *Attorney, Agent, or Firm*—Kenner, Otto, Boisselle & Sklar

(57) ABSTRACT

A super thin, cavity free spiral antenna includes a radiating element having a first spiral arm and a second spiral arm formed on a front surface of a first dielectric substrate. In addition, the antenna includes a resonant ground plane formed on a back surface of the first dielectric substrate. From the perspective of the radiating element, the resonant ground plane appears as a back ground plane which is further away from the radiating element than in actuality. As a result, operation in the microstrip mode is provided even without a cavity.

10 Claims, 3 Drawing Sheets

SUPER THIN, CAVITY FREE SPIRAL ANTENNA

This invention was made with Government support under N00024-95-C5400 awarded by The Department of the Navy. The Government has certain rights in this invention.

TECHNICAL FIELD

This invention relates to antennas, and more particularly to compact antennas.

BACKGROUND OF THE INVENTION

Past approaches for antenna design include spirals that are not sufficiently compact since their absorber cavities have generally been on the magnitude of a quarter wavelength ($\lambda$) deep. For example, an antenna designed for a frequency of 10 gigahertz (GHz), which has a wavelength $\lambda$ of approximately one inch, requires a cavity of at least a quarter inch in depth. Since this past approach matches the cavity's depth to that of the longest wavelength, it is not suitable for broadband operations.

Other past approaches for compact antennas include utilizing patch antennas. Patch antennas are relatively thin and can be on the order of 2% $\lambda$ in thickness. However, patch antennas are limited in bandwidth and are oftentimes too large for certain applications where space is considered a premium. Moreover, patch antennas cannot be dedicated to multioctave bandwidths.

Recently, a compact spiral antenna has been developed which overcomes some of the aforementioned disadvantages associated with conventional antennas. Commonly assigned U.S. Pat. No. 5,990,849 describes a compact spiral antenna with multioctave bandwidth capability. Nevertheless, this particular antenna also includes a cavity and thus is limited insofar as minimum thickness.

In view of the aforementioned shortcomings associated with conventional antennas, there exists a strong need in the art for an antenna which is both broadband and very thin. In particular, there is a strong need in the art for an antenna that can be employed without requiring adequate space for a cavity or the like. Moreover, there is a strong need for such an antenna which provides suitable gain (e.g, 8 dbi or more) for a variety of applications.

SUMMARY OF THE INVENTION

According to the present invention, a super thin, cavity free spiral antenna is provided. The antenna provides multioctave bandwidth capability with suitable gain, yet exhibits a very thin cavity-free profile.

The super thin, cavity free spiral antenna of the present invention is particularly suited for use in applications where space is at a premium. For example, the antenna of the present invention is useful in missiles where a smaller antenna allows more room for other electronics, etc. Also, the antenna of the present invention is useful in applications where aerodynamic drag or aesthetics is a concern. For example, the antenna may be mounted on the fuselage of an aircraft, the roof of an automobile, etc. Moreover, an antenna as thin as the present invention is suitable for mounting to a soldier's helmet or onto the side of a military vehicle as a retrofit, for example. In such instances where no room exists to insert a thick cavity antenna within the bounds of the outer skin, the super thin, cavity free spiral antenna of the present invention may be retrofitted onto the outer skin itself.

In accordance with one aspect of the present invention, a super thin, cavity free spiral antenna is provided. The antenna includes a radiating element comprising a first spiral arm and a second spiral arm formed on a front surface of a first dielectric substrate. In addition, the antenna includes a resonant ground plane formed on a back surface of the first dielectric substrate. The resonant ground plane includes a second dielectric substrate having a front surface adjacent the back surface of the first dielectric substrate; a third spiral arm and a fourth spiral arm formed on the front surface of the second dielectric substrate, the third spiral arm and the fourth spiral arm being commonly aligned with the first spiral arm and the second spiral arm, respectively, on opposite sides of the first dielectric substrate; a fifth spiral arm formed on a back surface of the second dielectric substrate, the fifth spiral arm being generally commonly aligned with the third spiral arm and the fourth spiral arm, on opposite sides of the second dielectric substrate; and at least one impedance element coupling the third spiral arm and the fourth spiral arm to the fifth spiral arm to form a resonant circuit. The antenna further includes a feedline configuration coupled to the first and second spiral arms for transmitting/receiving a high frequency signal via the antenna.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENT

Figure 1:
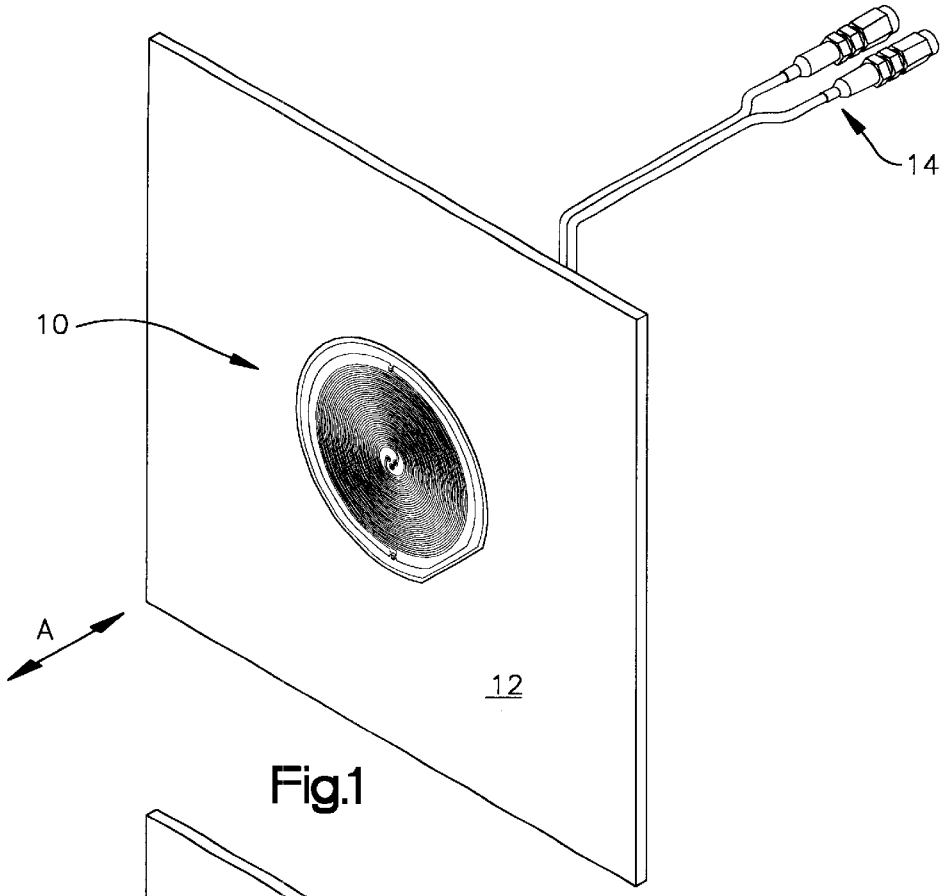
FIG. 1 is an environmental view of a super thin, cavity free spiral antenna in accordance with an exemplary embodiment of the present invention.

The present invention will now be described with reference to the drawings, wherein like reference numerals are used to refer to like elements throughout.

Referring initially to FIG. 1, a super thin, cavity free spiral antenna 10 is shown in accordance with the present invention. As will be better appreciated based on the discussion below, the antenna 10 is particularly suited for mounting on an electrically conductive flat surface 12. Such flat surface 12 may be the fuselage of an aircraft, a roof of an automobile or locomotive, a nose of a missile, a soldier's helmet, etc.

Despite being in such close proximity to the conductive surface 12 and the absence of a cavity, the antenna 10 is capable of suitably radiating or receiving a high frequency signal in a direction A normal to the surface 12. For example, a gain on the order of 8 dbi has been achieved. Moreover, the antenna 10 has been found to possess a sufficiently broadband response (e.g., on the order of 300 megahertz (MHz)).

Continuing to refer to FIG. 1, antenna cabling 14 is provided to couple a signal to be transmitted/received by the antenna 10 to a transmitter/receiver (not shown). In the exemplary embodiment, the cabling 14 is routed to the antenna 10 from being the surface 12 via an access hole described below. It will be appreciated, however, that the antenna 10 may be coupled to a transmitter/receiver via another configuration without departing from the scope of the invention.

Figure 2:
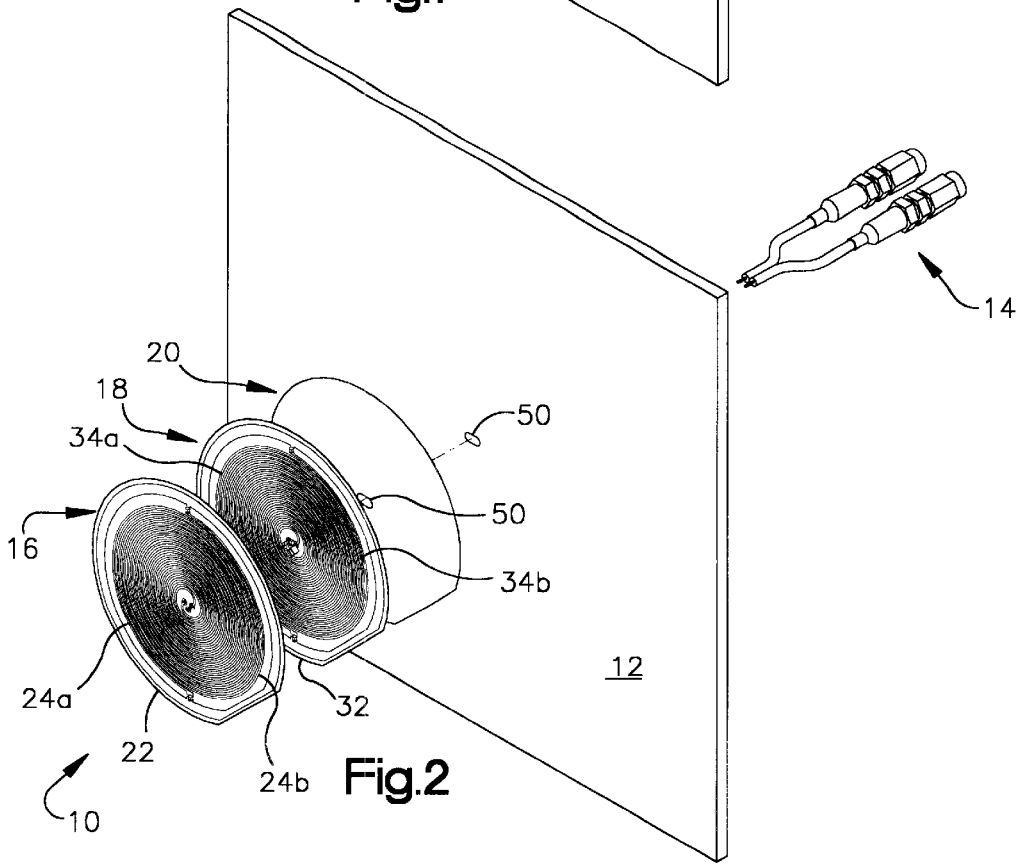
FIG. 2 is an exploded view of the antenna in accordance with the present invention.

FIG. 2 represents an exploded view of the antenna 10. As is shown in FIG. 2, the antenna 10 is made up of a plurality of thin layers. These layers, when combined, form a super thin antenna having a very low profile on the surface 12. This increases the aesthetics of the antenna 10 and provides a very low aerodynamic drag coefficient for those applications which require minimum drag.

Specifically, the antenna 10 includes multiple layers representing a radiating element 16, a resonant ground plane 18, and an insulator 20. As will be described in more detail below, the radiating element 16 includes spiral radiators which serve to radiate/receive a high frequency signal. The resonant ground plane 18 includes a corresponding set of spiral radiators which form a tuned resonant circuit and set up a capacitive ground plane relative to the radiating element 16. Since the resonant ground plane 18 resonates, the resonant ground plane 18 appears to the radiating element 16 as if the resonant ground plane 18 was located much further away from the radiating element 16 than in reality.

As a result, the resonant ground plane 18 allows the radiating element 16 to radiate in a microstrip mode rather than a stripline mode. Consequently, all the energy is launched directly off the antenna 10 in a direction A away from the surface 12 when transmitting.

The insulator 20 is a very thin RF-invisible electrically insulative layer which prevents the resonant ground plane 18 from being shorted directly to the surface 12. The surface 12 as shown in FIG. 2 is substantially larger than the antenna 10. However, it will be appreciated that the approximate diameter of the surface 12 need not be more than about one lambda (1λ), where lambda is the wavelength of the center operating frequency of the antenna 10.

Figure 3:
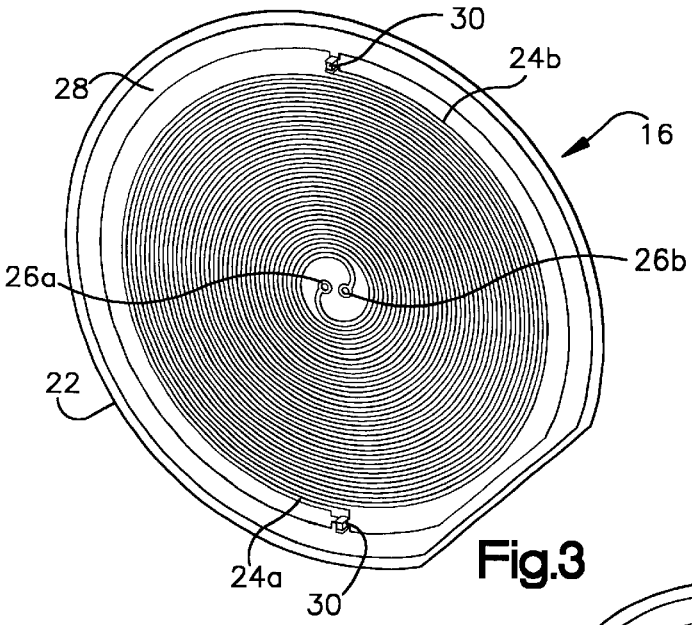
FIG. 3 illustrates a spiral arm pattern formed on the radiating element in accordance with the present invention.

Referring now to FIG. 3, the radiating element 16 includes a dielectric substrate 22. A front side of the substrate 22 (i.e., the side facing away from the surface 12) includes a pair of spiral arms 24*a* and 24*b* formed of electrically conductive traces via photolithography or the like as is known. The spiral arms 24*a* and 24*b* spiral about a common axis and have standard dimensions, spiral pitch, etc. as is commonly found in microstrip spiral antennas designed for broadband operation. Each spiral arm 24*a* and 24*b* originates at electrical terminal pads 26*a* and 26*b*, respectively, located at the center of the substrate 22. The spiral arms 24*a* and 24*b* spiral outward and are each terminated at their ends to an outer grounding ring 28 via a termination resistor 30. A back side of the substrate 22 (i.e., the side facing the surface 12) is simply the blank substrate 22 and has nothing formed thereon insofar as the exemplary embodiment.

Figure 4:
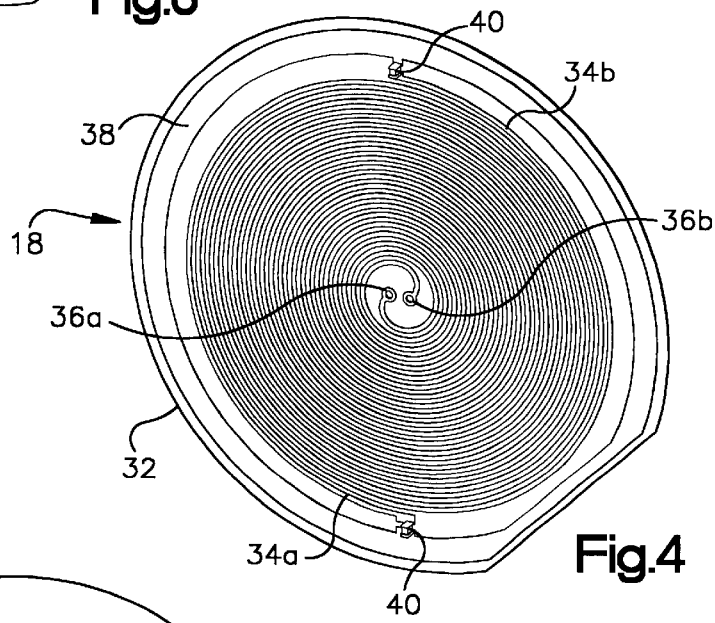
FIG. 4 illustrates a spiral arm pattern formed on one side of the resonant ground plane in accordance with the present invention.

As is shown in FIG. 4, the resonant ground plane 18 includes a dielectric substrate 32. Like the radiating element 16, a front side of the resonant ground plane 18 (i.e., the side facing away from the surface 12) also includes a pair of spiral arms 34*a* and 34*b* formed of electrically conductive traces via photolithography or the like as is known. The spiral arms 34*a* and 34*b* have the same dimensions, spiral pitch, etc. as the spiral arms 24*a* and 24*b*, respectively. When assembled, the spiral arms 34*a* and 34*b* are located so as to be directly opposite and commonly aligned with the spiral arms 24*a* and 24*b*, respectively, relative to the opposite sides of the substrate 22. In other words, the spiral arms 34*a* and 34*b* on the front side of the substrate 32 intentionally mirror the spiral arms 24*a* and 24*b* on the front side of the substrate 22.

Each spiral arm 34*a* and 34*b* originates at electrical terminal pads 36*a* and 36*b*, respectively, located at the center of the substrate 32. As with the spiral arms included in the radiating element 16, the spiral arms 34*a* and 34*b* spiral outward and are each terminated at their ends to an outer grounding ring 38 via a termination resistor 40.

Figure 5:
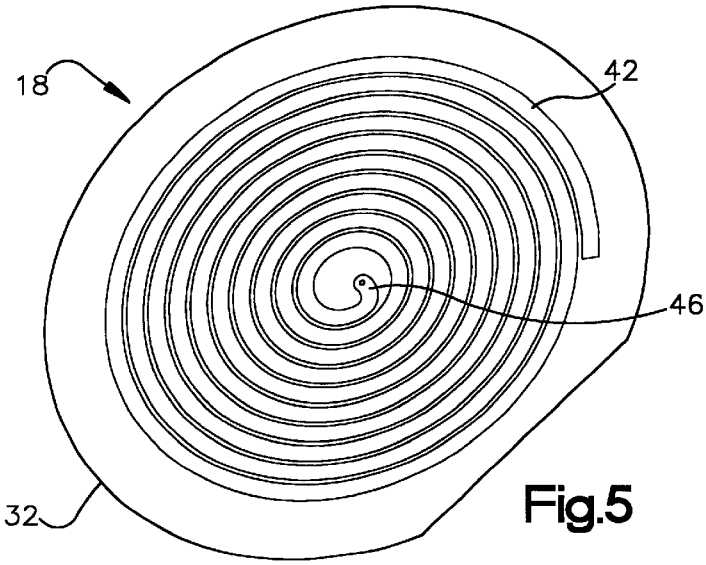
FIG. 5 illustrates a spiral arm pattern formed on the other side of the resonant ground plane in accordance with the present invention.

Referring now to FIG. 5, the resonant ground plane 18 further includes on a back side of the substrate 32 (i.e., the side facing the surface 12) a single spiral arm 42. The spiral arm 42 is also formed of an electrically conductive trace via photolithography or the like. However, the spiral arm 42 is relatively wide in relation to the width of each of the spiral arms 34*a* and 34*b* on the front side of the substrate 32. For example, width of the spiral arm 42 may be approximately equal to the combined widths of the spiral arms 34*a* and 34*b* and the spacing therebetween. The direction of spiral of the spiral arm 42 is the same as that of the spiral arms 34*a* and 34*b*, and the spiral arm 42 is generally co-aligned with the spiral arms 34*a* and 34*b* on opposite sides of the substrate 32. The spiral arm 42 originates in the center of the antenna 10 at electrical terminal pad 46 and spirals outward as shown in FIG. 5. Unlike the other spiral arms 24*a*, 24*b*, 34*a* and 34*b*, however, the spiral arm 42 is not terminated to a grounding ring and instead floats electrically.

As is described in more detail below in connection with FIG. 7, the spiral arms 34*a* and 34*b* and spiral arm 42 are electrically connected together by one or more impedance elements to form a tuned circuit designed to resonate at the operating frequency of the antenna 10. The capacitive coupling between the spiral arms 34*a*, 34*b* and the spiral arm 42 through the substrate 32 combines with the reactance of the impedance elements to form an LC circuit. In turn, the spiral arms 34*a* and 34*b* of the resonant ground plane 18 are capacitively coupled to the spiral arms 24*a* and 24*b* of the radiating element 16. The impedance elements used to interconnect the spiral arms 34*a*, 34*b* and 42 may be low profile inductors, capacitors and/or resistors (not shown) which are mounted on the front and/or back surface of the substrate 32. Plated through vias (not shown) for interconnections between the spiral arms 34*a* and 34*b* on the. front side and the spiral arm 42 on the back side may be provided as needed.

Figure 6:
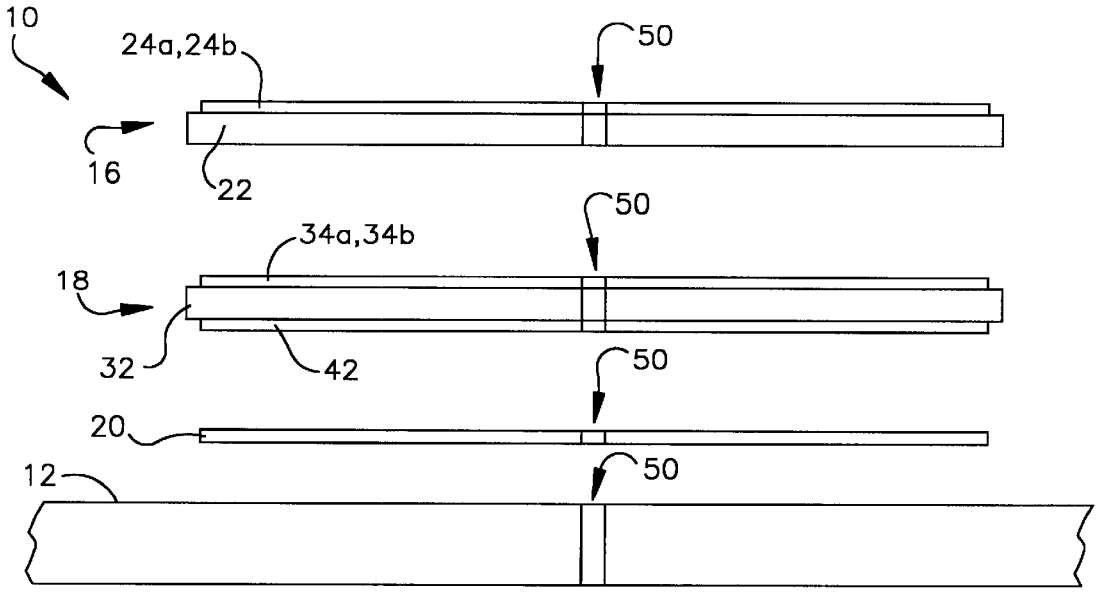
FIG. 6 is a schematic view representing a stack which forms the antenna in accordance with the present invention.

FIG. 6 is a schematic illustration of the various layers making up the antenna 10. Although the layers are shown as being spaced apart for ease of understanding, it will be appreciated that the respective layers are laminated directly together to form a super thin, cavity free antenna structure. As is shown in FIG. 6, the antenna 10 includes the radiating element 16 having the spiral arms 24*a* and 24*b* formed on the front side of the substrate 22. Immediately beneath the radiating element 16 is the resonant ground plane 18. The resonant ground plane 18 includes the spiral arms 34*a* and

34*b* formed on the front side of the substrate 32, and the spiral arm 42 formed on the back side of the substrate 32. The insulator 20 is disposed between the resonant ground plane 18 and the electrically conductive surface 12.

Although not shown in FIG. 6, various layers of RF-transparent adhesive may be interspersed between the respective layers 16, 18 and 20 in order to bond the assembly into a single laminate structure 10. The antenna 10 may then be mounted directly to the surface 12. Also, although not shown in FIGS. 1 and 3–5, each of the layers 16, 18 and 20 and the surface 12 include appropriate electrically isolated vias or through holes 50 which permit the coaxial feed lines from the antenna cabling 14 to be coupled to the spiral arms 24*a* and 24*b* from a back side of the surface 12.

In an exemplary embodiment of the present invention designed to operate in the lower S-band (e.g., approximately 2 Gigahertz (Ghz)), each of the substrates 22 and 32 is a 0.003-inch thick dielectric substrate. The spiral arms 24*a*, 24*b*, 34*a*, 34*b* and 42 are each made of 0.0014-inch thick copper layer photolithographically etched on the respective sides of the substrates 22 and 32. The insulator 20 may be a non-conductive plastic film having a thickness on the order of 0.002 inch. For example, conventional transparent tape may serve to form the insulator 20 layer. Thus, the total thickness of the antenna 10 in such an embodiment is approximately 12.2 mils. Such an antenna 10 has been found to exhibit about 8 dbi of gain, and has a thickness which is two orders of magnitude thinner than a conventional microstrip spiral antenna. Using various materials, one can easily achieve a total thickness of 10 mils to 20 mils, for example.

Figure 7:
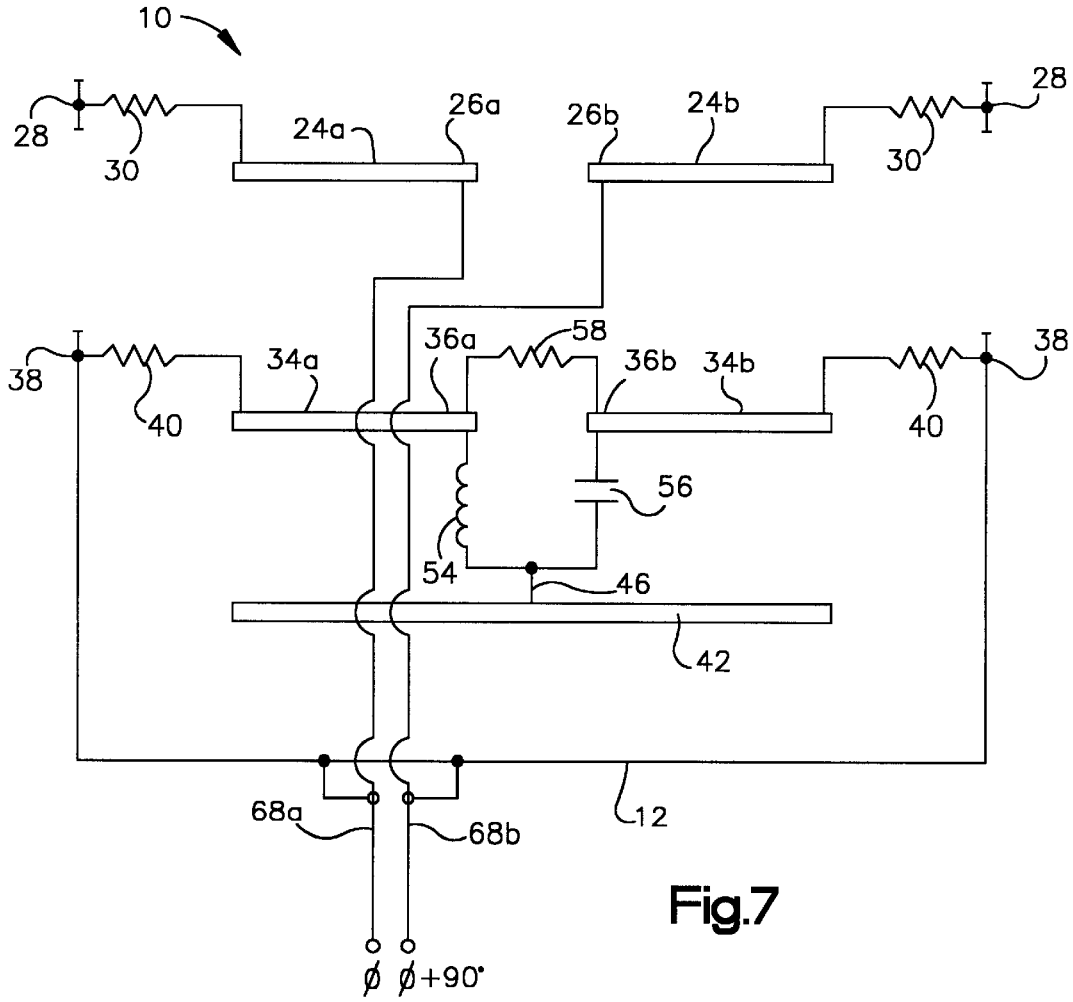
FIG. 7 is a schematic diagram illustrating the electrical connections between the respective elements within the antenna in accordance with the present invention.

FIG. 7 represents an exemplary electrical connection of the respective elements in accordance with the present invention. As mentioned above, the spiral arms 34*a*, 34*b* and 42 making up the resonant ground plane 18 are interconnected via one or more impedance elements to form a resonant circuit tuned at the desired operating frequency. In the exemplary embodiment, the spiral arm 42 is electrically coupled to the spiral arms 34*a* and 34*b* through a corresponding via in the substrate 32 (not shown). In particular, an inductor 54 is connected between the terminal pad 46 of the spiral arm 42 and the terminal pad 36*a* of the spiral arm 34*a*. Similarly, a capacitor 56 is coupled between the terminal pad 46 of the spiral arm 42 and the terminal pad 36*b* of the spiral arm 34*b*. Finally, a resistor 58 is coupled between the terminal pad 36*a* of the spiral arm 34*a* and the terminal pad 36*b* of the spiral arm 34*b*.

The values of the inductor 54, capacitor 56 and resistor 58 are selected in combination with the capacitive coupling which occurs between the spiral arms 34*a*, 34*b* and 42 so as to form a resonant circuit having its Q point at the desired operating frequency of the antenna 10 (e.g., 2.0 Ghz). Such values may be obtained empirically and/or via modeling as will be appreciated. In the exemplary embodiment described herein, the various impedances are as follows (although it will be appreciated that the present invention is by no means intended to be limited to such particular values):

| | |
|---|---|
| Inductor 54: | 22 nanohenrys (nH) |
| Capacitor 56: | 0.5 picofarads (pF) |
| Resistor 58: | 50 ohms (Ω) |
| Resistors 30, 40: | 180 ohms (Ω) |

As further shown in FIG. 7, the grounding ring 28 is isolated from the electrically conductive surface 12. The grounding ring 38 is electrically coupled to the electrically conductive surface 12 so as to serve as a common ground. The antenna cabling 14 includes feed lines 68*a* and 68*b* which extend through the through holes 50 and are connected at one end to the terminal pads 26*a* and 26*b* of the spiral arms 24*a* and 24*b*, respectively. The outer sheaths of the coaxial antenna cabling 14 are coupled to the common ground (e.g., the surface 12).

In use, a hybrid (not shown) is provided at an input end of the feed lines 68*a* and 68*b* to introduce a 90° phase difference between the spiral arms 24*a* and 24*b*. In addition, the hybrid may include an impedance matching transformer to match the impedance of the antenna to that of the transmitter/receiver as is conventional. It will be appreciated that the spiral arms 24*a* and 24*b* may be configured in some other manner without departing from the scope of the invention.

When receiving a signal using the antenna 10, the received signal excites the spiral arms 24*a* and 24*b* of the radiating element 16. The resulting changing E-field is capacitively coupled to the resonant ground plane 18 through the substrate 22, which in turn causes the resonant ground plane 18 to resonate. Consequently, the resonant ground plane 18 appears to the radiating element 16 to be much further away than it really is so as to appear electrically as if a cavity was present. This allows the radiating element 16 to operate in a microstrip mode as desired.

Similarly, when transmitting using the antenna 10 the spiral arms 24*a* and 24*b* are excited via the feed lines 68*a* and 68*b*. This in turn stimultates the resonant ground plane 18 in the same manner. Thus, the radiating element 16 again is able to operate in a microstrip mode.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A super thin, cavity free spiral antenna, comprising:

a radiating element comprising a first spiral arm and a second spiral arm formed on a front surface of a first dielectric substrate;

a resonant ground plane formed on a back surface of the first dielectric substrate, the resonant ground plane comprising:

a second dielectric substrate having a front surface adjacent the back surface of the first dielectric substrate;

a third spiral arm and a fourth spiral arm formed on the front surface of the second dielectric substrate, the third spiral arm and the fourth spiral arm being commonly aligned with the first spiral arm and the second spiral arm, respectively, on opposite sides of the first dielectric substrate;

a fifth spiral arm formed on a back surface of the second dielectric substrate, the fifth spiral arm being generally commonly aligned with the third spiral arm and the fourth spiral arm, on opposite sides of the second dielectric substrate; and at least one impedance element coupling the third spiral arm and the fourth spiral arm to the fifth spiral arm to form a resonant circuit; and a feedline configuration coupled to the first and second spiral arms for transmitting/receiving a high frequency signal via the antenna.

2. The antenna of claim 1, wherein the resonant ground plane enables the radiating element to radiate in predominately a microstrip mode.

3. The antenna of claim 1, wherein the resonant ground plane is designed to resonate as a result of capacitive coupling with the radiating element through the first dielectric substrate.

4. The antenna of claim 1, wherein the first thru fourth spiral arms are relatively thin and the fifth spiral arm is relatively wide.

5. The antenna of claim 1, wherein a total thickness of the antenna is approximately within the range of 10 mils to 20 mils.

6. The antenna of claim 5, wherein the antenna is designed to operate in the S band.

7. The antenna of claim 1, further comprising an electrically insulating layer interposed between the fifth spiral arm and an electrically conductive surface onto which the antenna is mounted.

8. The antenna of claim 1, wherein the first spiral arm and the second spiral arm are configured to be driven 90° out of phase with one another.

9. The antenna of claim 1, wherein the at least one impedance element comprises at least one of an inductor and a capacitor.

10. The antenna of claim 1, wherein each of the first thru fourth spiral arms is terminated to a ground via a terminating element, and the fifth spiral arm is not terminated to ground.

* * * * *